US008763271B2

(12) United States Patent
Taylor

(10) Patent No.: US 8,763,271 B2
(45) Date of Patent: Jul. 1, 2014

(54) PAINT APPLICATOR CLEANING DEVICE

(76) Inventor: David Brian Taylor, Portsmouth (GB)

( * ) Notice: Subject to any disclaimer, the term of this patent is extended or adjusted under 35 U.S.C. 154(b) by 979 days.

(21) Appl. No.: 12/866,292

(22) PCT Filed: Jan. 30, 2009

(86) PCT No.: PCT/GB2009/000258
§ 371 (c)(1),
(2), (4) Date: Jun. 4, 2011

(87) PCT Pub. No.: WO2009/095678
PCT Pub. Date: Aug. 6, 2009

(65) Prior Publication Data

US 2011/0225836 A1 Sep. 22, 2011

(30) Foreign Application Priority Data

Feb. 1, 2008 (GB) ..... 0801818.6

(51) Int. Cl.
*F26B 17/30* (2006.01)

(52) U.S. Cl.
USPC ..... 34/58

(58) Field of Classification Search
USPC ..... 34/58, 312; 15/146, 257.01; 134/6, 38, 134/201; 279/52, 53, 48, 42, 155
See application file for complete search history.

(56) References Cited

U.S. PATENT DOCUMENTS

| | | | | |
|---|---|---|---|---|
| 2,653,029 A * | 9/1953 | Shore | 279/53 |
| 2,884,709 A | 5/1959 | Kruger | |
| 5,185,938 A | 2/1993 | Hutt | |
| 5,621,979 A * | 4/1997 | Taylor | 34/58 |
| 5,784,798 A * | 7/1998 | Taylor | 34/58 |
| 6,115,935 A | 9/2000 | Collins | |
| 6,347,463 B1 | 2/2002 | Novak | |

FOREIGN PATENT DOCUMENTS

| | | | |
|---|---|---|---|
| CA | 2358113 * | 3/2003 | A46B 17/06 |
| DE | 1102615 | 3/1961 | |
| GB | 867960 | 5/1961 | |
| GB | EP 0684909 | 12/1995 | |

* cited by examiner

*Primary Examiner* — Kenneth Rinehart
*Assistant Examiner* — Tavia Sullens
(74) *Attorney, Agent, or Firm* — Jennifer Meredith, Esq.; Meredith & Keyhani, PLLC

(57) ABSTRACT

A paint applicator cleaning device having a drive shaft; a hub in communication with the drive shaft having: an external screw thread, a coaxial socket opening into the spigot and an external abutment positioned between the drive shaft and the spigot; a paint-brush-handle tip locator having: a socket at one end adapted to receive a paint-brush-handle tip and a stem at its other end received in the socket; a spring housed in the socket in the hub for urging the tip locator outwards of the socket; a paint-brush shank holder having: a tubular portion with an internal thread complementary to the external screw thread of the hub, a plain bore for centering the socket of the tip locator, a pair of tangs and a pair of jaws at the distal ends of the tangs for gripping the paint brush shank; and a sleeve sized to surround the tubular portion.

19 Claims, 3 Drawing Sheets

PAINT APPLICATOR CLEANING DEVICE

This application is a national stage under 35 U.S.C. 371 of International Application No. PCT/GB2009/00258 filed Jan. 30, 2009 which claims priority to and the benefit of United Kingdom patent application number 0801818.6 filed in the United Kingdom Feb. 1, 2008.

The present invention relates to a paint applicator cleaning device.

Devices are known for cleaning paint brushes and paint roller sleeves and in particular for spinning washing liquid, in particular water, out of them.

My existing paint brush cleaner is the subject of EP 0 684 909/WO 9416909, of which the abstract is as follows:

A drive attachment device, particularly adapted to receive and transmit drive to the
handle of a paint brush, comprises a body having a socket for receiving the end of a paint brush, and resilient retaining means in the form of tension springs mounted on pegs to span an opening through which the handle of the paint brush is introduced when being fitted to the device. The tension springs exert sufficient force on the paint brush handle both to retain it in position against axial displacement and to transmit rotation when the body is rotated.

My existing paint cleaner is the subject of EP 0 805 760/WO 9622890, of which the abstract is as follows:

A drive transmission implement for rotating a paint roller body having an axial through-bore for releasably receiving a shaft, comprises a spindle having a first end portion adapted to receive drive to rotate it about its axis, a second end portion adapted to fit into the axial through-bore in the roller body, a clutch device carried by the spindle intermediate the end portions and means for retaining a roller body fitted on to the second spindle portion in engagement with the clutch device to enable rotational drive to be transmitted from the spindle to the roller body, particularly for cleaning.

I have become aware of CA 2,358,113 of which the abstract is as follows: In a tool for removing liquid from paint brushes and rollers, it is known to have a plunger with a tight fitting spring at one end and a cylindrical cone shape groove in the other end. The plunger and spring are mounted as a floating self-centering device within a tube, which at one end has a stopper shoulder and a drill attachment and at the opposite end is open with threads on the nutter (sic) side of the tube, this tube section of the invention is known as the arbour. Mounted inside the threaded end of the arbour tube is a collet, into which a paint brush would be placed, the collet is used to secure a paint brush into place within the invention. Mounted externally round the arbour tube is another tube which is held in position at the bottom by the shoulder of the arbour tube and at the opposite end with a pinching washer which is positioned below the threads at the top of the arbour tube. Mounted onto the threaded end of the arbour tube is a nut. The nut is open at both ends and is shaped to allow the collet to fit snugly within the nut so as, when tightened, to lock the collet into position inside the threaded end of the arbour tube.

Further, I have become aware of U.S. Pat. No. 5,185,938 of which the abstract is as follows:

An attachment securable to the chuck of a hand-held power drill and adapted to clamp either a paint brush or a paint roller, so as to spin the same for cleaning by centrifugal force. The attachment is made of three separate parts, namely: a jaw unit, a sleeve and a cap nut, the latter provided with a spindle for insertion into the power tool chuck. The jaw unit includes a screw portion threaded within the cap nut and having a cylindrical extension in turn extended by a pair of spring jaws for receiving therebetween and clamping the narrower portion of a paint brush handle adjacent the brush bristles. A sleeve surrounds the arms of the two jaws and its opposite ends engage the cap nut and conical wedging surfaces of the jaw heads. Rotation of the cap nut with respect to the jaw unit causes axial movement of the sleeve which in turn causes retraction of the jaw to clamp the brush handle. The outer surface of the sleeve has paint roller clamping ribs to hold a paint roller around the sleeve. In the second embodiment, the outer end of the sleeve is provided with slits defining deflectable lugs therebetween, which are deflected radially outwardly upon further insertion of the jaw heads within the sleeve, so as to provide additional clamping of the paint brush roller.

The object of the present invention is to provide an improved paint applicator cleaning device, capable of accommodating as wide a range of paint brushes as reasonably possible and of cleaning paint roller sleeves as well with the same device.

In my developments to this end, I have noted that paint brushes have varying shapes of handle. In particular some have round tips and others have rounded corner rectangular section tips. Some are longer than others. Some permit better gripping at the bristle end of the handle than others. Some have a cross-sectional dimension mitigating against use of certain prior art features.

However, of central importance, in particular to well centered location of the head of the brush, bearing in mind that it may be spun at 2,500 rpm by an electric drill, is not only a pair of jaws arranged to close at equal radial distance from the central axis of the device, but also a similarly well centered paint brush tip locator.

The centering of the tip locator is a particular challenge, in view of the need for it to be differently axially positioned in the device with differing lengths of brush handle.

Accordingly in my present invention I provide a paint applicator cleaning device comprising:

- a drive shaft;
- a hub fast with the drive shaft, which protrudes from one end of the hub, the hub having:
  - an external screw thread on a spigot extending oppositely from the drive shaft and coaxial therewith,
    - a coaxial socket opening into the spigot from its end remote from the drive shaft and
    - an external abutment against longitudinal movement positioned between the drive shaft and the spigot;
  - a paint-brush-handle tip locator ("the tip locator") having:
    - a socket at one end adapted to receive a paint-brush-handle tip and
    - a stem at its other end sized to be received coaxially in the socket of the hub;
  - a spring housed in the socket in the hub for urging the tip locator outwards of the socket;
  - a paint-brush shank holder ("the shank holder") having:
    - a tubular portion with an internal thread complementary to the external screw thread of the hub,
    - a plain bore for centering the socket of the tip locator (depicted as internal collar 46),
    - a pair of tangs extending generally in the direction of the central axis of the internal screw thread from one end of the tubular portion and spaced on opposite sides of the central axis and
    - a pair of jaws at the distal ends of the tangs for gripping the paint brush shank; and
  - a sleeve sized to surround the tubular portion and extend between the abutment and the jaws, the jaws and the tubular portion being complementarily formed whereby threading of the shank holder towards the hub urges the jaws towards each other.

Preferably, the shank holder is a moulding of plastics material, rendering the tangs resilient for their separation on threading of the shank holder away from the hub.

In the preferred embodiment:

the tubular portion of the shank holder has an internal collar, providing the plain bore and having an internal diameter smaller than its internal screw thread, the tip locator has an external diameter of its socket end sized to fit within the collar, the tip locator has an external collar larger in diameter than the external diameter of its socket end, the arrangement being such that the shank holder captures the tip locator between the internal collar and the hub, with the spring being captured by the captured tip locator, the external stem is sized to be received within the coaxial socket of the hub, the socket end of the tip locator has a diameter reduced from the external collar and the coaxial socket has a complementarily counter-bore, the arrangement limiting movement of the tip locator inwards of the hub, the coaxial socket and the tip locator are dimensioned for bottoming of the tip locator in the socket with the external collar clear of the inner end of the counter-bore when the shank holder is threaded fully onto the hub, the outer end of the tip locator and/or the inner side of the internal collar are tapered for centering of the tip locator in the shank holder, the tip locator has a bore in its inner end for receiving the spring.

It is envisaged that both the tip locator and the socket in the hub can be formed with spring engagements, whereby the spring is engaged with each and the tip locator is retained with the device.

Again in the preferred embodiment:

the tip locator has steps in its socket for centering different sizes of paint brush tip, the tip locator is dimensioned to extend out of the internal collar when its external collar abuts the internal collar, the portion of the tip locator so extending being bifurcated to receive a paint brush tip wider than it is thick, the complementary formation of the jaws are wedge faces for abutting the sleeve, the jaws have concave gripping faces for centering a paint brush shank, the jaws are formed with open bottom slots set back from the gripping faces to provide the faces with resilience, the tubular portion of the shank holder is a clearance size with respect to the internal size of the sleeve, the tangs extend from the tubular portion at the same external diameter as the tubular portion in their free state, a collar is included for centering a paint roller cover on the device at the hub end of the device, the jaws centering paint roller cover remote from the hub, the hub has a groove on the drive shaft side of its sleeve abutment and the collar has a rim dimensioned to locate in the groove, To help understanding of the invention, a specific embodiment thereof will now be described by way of example and with reference to the accompanying drawings, in which:

Figure 1:
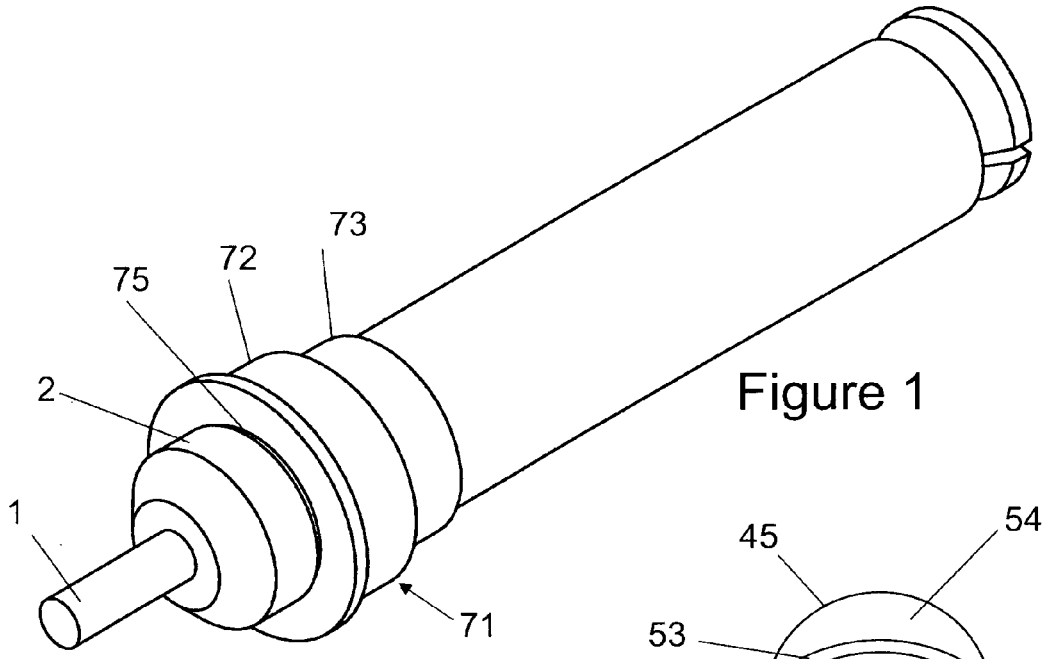
FIG. 1 is a perspective view of a paint applicator cleaning device according to the invention.
Figure 7:
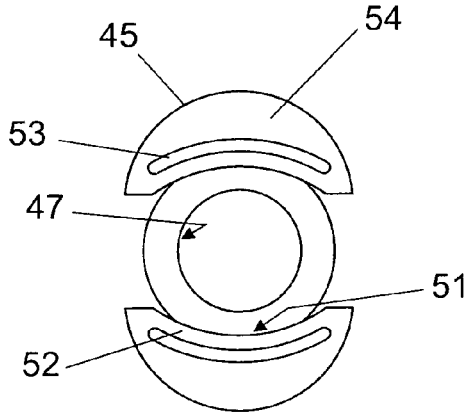
FIG. 7 is an end view of the shank holder.
Figure 2:
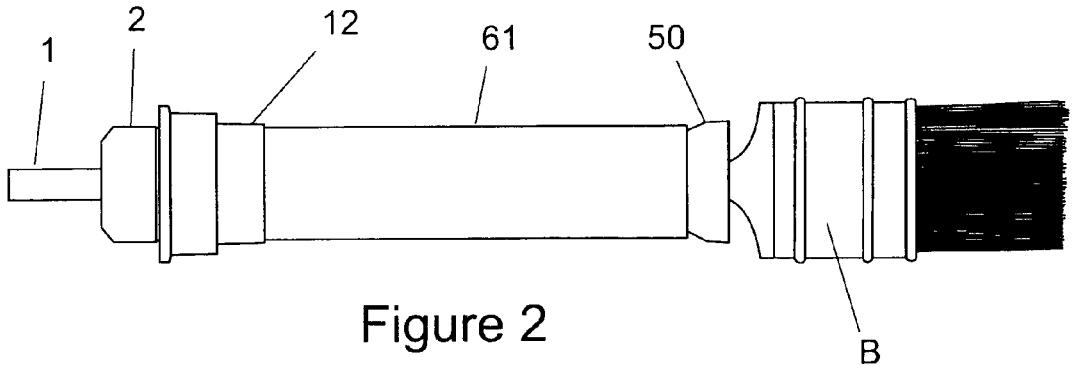
FIG. 2 is a side view of the device of FIG. 1 gripping a paint brush.
Figure 3:
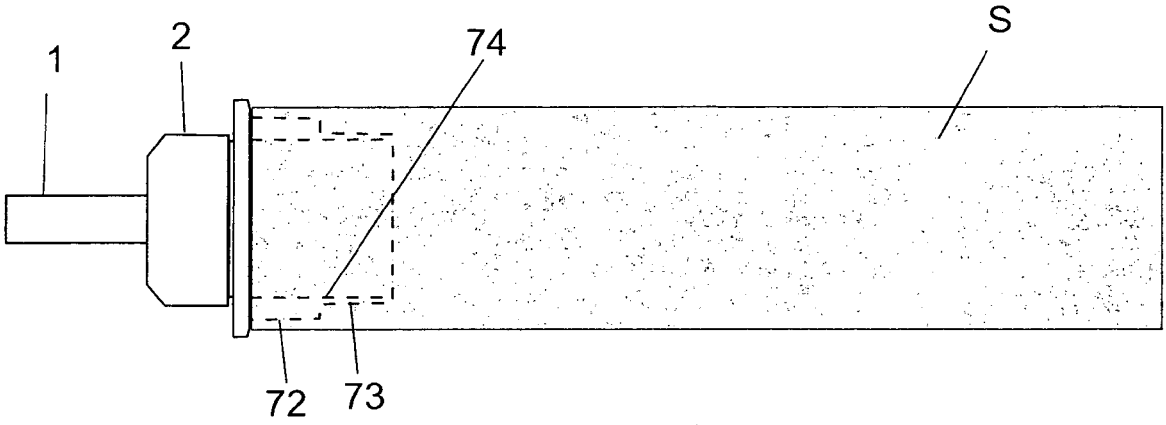
FIG. 3 is a similar view of the device gripping a paint roller sleeve.
Figure 4:
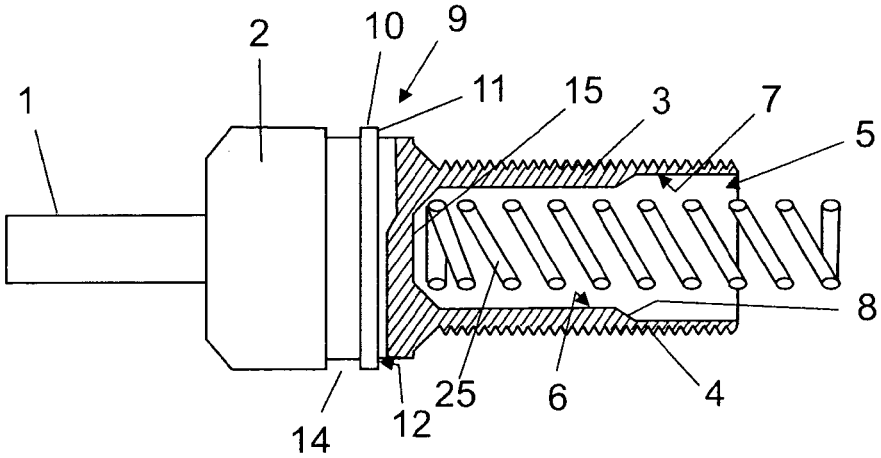
FIG. 4 is a partially sectioned side view of a hub of the device.
Figure 5:
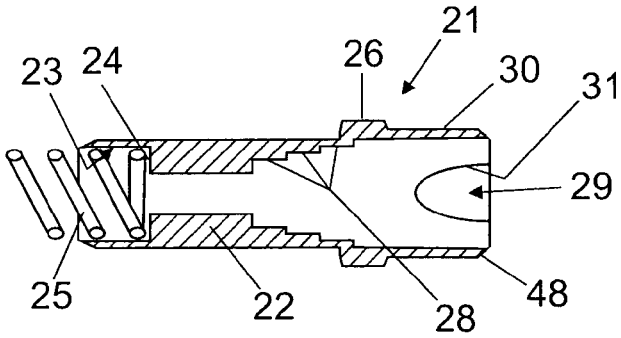
FIG. 5 is a cross-sectional side view of a tip locator of the device.
Figure 6:
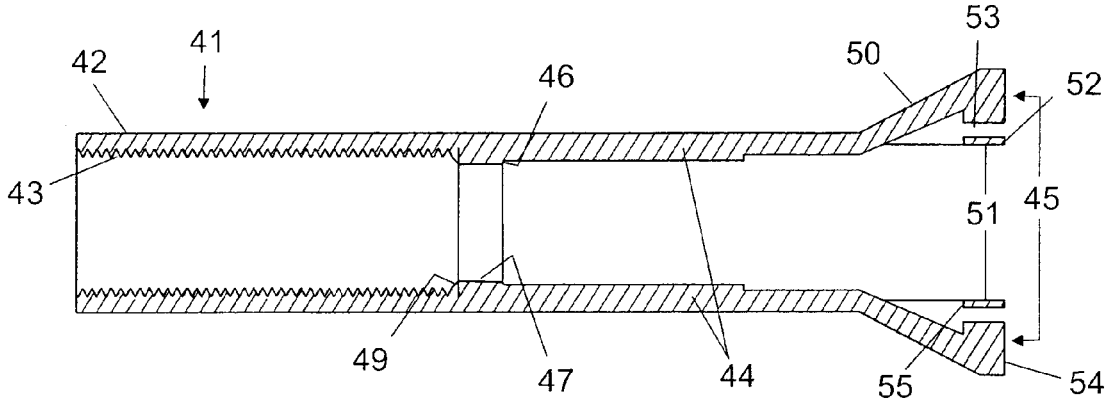
FIG. 6 is similar view of a shank holder of the device.
Figure 8:
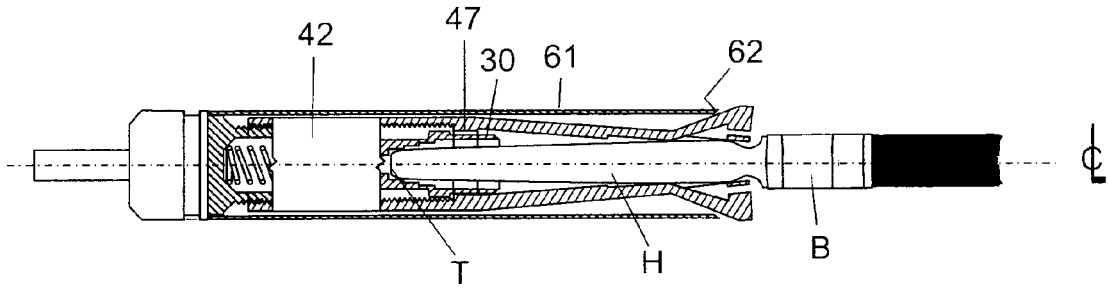
FIG. 8 is a partially sectioned view of the device gripping a small paint brush.
Figure 9:
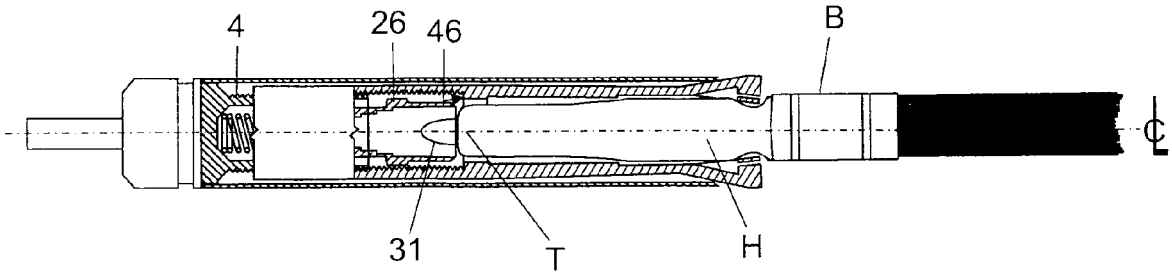
FIG. 9 is a similar view of the de vice gripping a large paint brush.

Referring to the drawings, a device for cleaning a paint brush B and/or a paint roller sleeve S by spinning paint out of them is shown. Normally, the paint will have been diluted to some extent before spinning. Further, the cleaning process can involve successive dilutions and spinnings.

Typically the spinning is carried out by means of an electric drill (not shown) with a drive shaft 1 of the device held in the drill's chuck. It will be appreciated that gripping of a paint brush with minimum eccentricity is important. The description below discloses features for enhancing concentricity.

The shaft is fast in a hub 2, of plastics material, which is moulded around the shaft. Opposite from the shaft, the hub has a spigot 3 with an external screw thread 4 and a socket 5 having bore 6 opening at the end of the spigot with a counter-bore 7. A step 8 is provided at the inner end of the counter bore. At a larger diameter portion 9 of the hub, it has a small collar 10, providing at an end face 11 an abutment 12. Behind the collar is a circumferential groove 14.

A paint brush tip locator 21, that is a member for locating the tip T of a handle H of a paint brush B being cleaned on the central axis CL of the device, is partially housed in the socket 5/bores 6,7. It has an inner stem 22, which has a bore 23 with a bottom 24 forming an abutment for a spring 25. The stem 22 is a clearance size in the bore 6. Outwards of the stem is an external collar 26, which is a clearance size in the counter-bore 7. This arrangement provides that the tip locator bottoms in the bores with the collar abutting the step 8 between the bores. In this condition, the spring is compressed between the bottom 24 of the bore 23 and the bottom 15 of the bore 6. Within the stem, outwards of the bottom 24, the tip locator has a series of steps 28 in a socket 29 opening at the outer end of the locator and sized to receive a paint brush handle tip. This socket end has an outer diameter 30 intermediate the diameter of the stem 22 and the collar 26. The end portion of the socket is bifurcated with two divergent U-shaped nicks 31.

The external diameter of the socket 29 is 19 mm and the respective internal diameters of the stepped portions of it are 16 mm, 14 mm, 12 mm, 10 mm, with the steps being set 5 mm apart.

Thus the tip locator can receive and center a wide variety of paint brush tips, in fact the tips of all styles of brush that I am aware of up to a 4 inch, 100 mm, wide brush. Further, since the tip locator can move against the spring 25, a differing lengths of brush handle are accommodated.

When the tip locator is extended out of the socket or at least no longer accurately radially located by it, it still located by the paint-brush-handle shank holder 41, now described. It is a plastics material moulding with a tubular portion 42 having an internal screw thread 43, complementary to the external screw thread 4. Two tangs 44 extend from the tubular portion. The tangs are diametrically opposite each other and carry jaws 45 at their distal ends. At their proximal ends, the tubular portion has an internal collar 46, with an internal diameter 47 less than the internal diameter of the thread 43. The diameter 47 is a clearance diameter for the tip socket 29 of the tip locator. Thus the internal collar 46 performs the dual functions of radially locating the tip locator and longitudinally locating against the action of the spring 25, in a position determined by the position of the shank holder with respect to the hub. Long handled brushes can of course hold the tip locator further within the socket of the hub.

The tip socket and the internal collar are such as to allow the bifurcated portion of the tip socket to extend from within the collar. For brushes with the largest of tips, the latter can be centered in the internal collar itself. Such use can force the tip locator inwards of the internal collar altogether. To ease its return under the action of the spring, its end 48 and the inside face 49 of the internal collar are tapered for centering of the tip locator. The jaws 45 have frusto-conical surfaces 50 facing back towards the tubular portion and concave gripping faces 51. These are provided on bands 52, with slots 53 open at both the end faces 54 of the jaws and the inner ends 55 of the faces 51. This arrangement not only gives the jaws centering action, when gripping the shank of a paint brush handle, but also resilience enabling firm grip of the handle.

The jaws are driven together by an outer sleeve 61 acting in abutment with the abutment 12 and the tapered jaw surfaces 50. The end 62 of the sleeve abutting the jaws being internally tapered. Thus as the hub and the shank holder are threaded together, the jaws are forced together for gripping a paint brush handle between them, the handle having already been thrust against the tip locator.

For cleaning a paint roller sleeve S, a split band 71, with a pair of differing diameter external surfaces 72, 73—for different diameter sleeves—is provided with an internal diameter 74 to be a light interference fit with the sleeve 61 and an inside rim 75 for locating in the circumferential groove 14. In use the jaws allowed spring out to a diameter gripping the inside of the roller sleeve.

The invention claimed is:

1. A paint applicator cleaning device comprising:

a drive shaft;

a hub in communication with the drive shaft, wherein the drive shaft protrudes from one end of the hub, the hub having:

an external screw thread on a spigot extending oppositely from the drive shaft and coaxial therewith, a coaxial socket opening into the spigot from its end remote from the drive shaft and an external abutment against longitudinal movement positioned between the drive shaft and the spigot;

a paint-brush-handle tip locator ("the tip locator") having:

a socket at one end adapted to receive a paint-brush-handle tip and a stem at its other end sized to be received coaxially in the socket of the hub;

a spring housed; in the socket in the hub for urging the tip locator outwards of the socket;

a paint-brush shank holder ("the shank holder") having:

a tubular portion with an internal thread complementary to the external screw thread of the hub, a plain bore for centering the socket of the tip locator, a pair of tangs extending generally in the direction of the central axis of the internal thread from one end of the tubular portion and spaced on opposite sides of the central axis and a pair of jaws at the distal ends of the tangs for gripping the paint brush shank; and a sleeve sized to surround the tubular portion and extend between the abutment and the jaws, the jaws and the tubular portion being complementarily formed such that threading of the shank holder towards the hub urges the jaws towards each other.

2. A cleaning device as claimed in claim 1, wherein the shank holder is a moulding of plastics material, rendering the tangs resilient for their separation on threading of the shank holder away from the hub.

3. A cleaning device as claimed in claim 1, wherein:

the tubular portion of the shank holder has an internal collar, providing the plain bore and having an internal diameter smaller than its internal thread, and the tip locator has an external diameter of its socket end sized to fit within the collar.

4. A cleaning device as claimed in claim 1, wherein the tip locator has an external collar larger in diameter than the external diameter of its socket end.

5. A cleaning device as claimed in claim 4, wherein the external collar is sized to be received within the coaxial socket of the hub.

6. A cleaning device as claimed in claim 4, wherein the socket end of the tip locator has a diameter reduced from the external collar and the coaxial socket has a complimentary counter-bore, the arrangement limiting movement of the tip locator inwards of the hub.

7. A cleaning device as claimed in claim 4, wherein the coaxial socket and the tip locator are dimensioned for bottoming of the tip locator in the socket with the external collar clear of the inner end of the counter-bore when the shank holder is threaded fully onto the hub.

8. A cleaning device as claimed in claim 7, wherein the outer end of the tip locator and/or the inner side of the internal collar are tapered for centering of the tip locator in the shank holder.

9. A cleaning device as claimed in claim 1, wherein the tip locator has a bore in its inner end for receiving the spring.

10. A cleaning device as claimed in claim 1, wherein both the tip locator and the socket in the hub are engaged by the spring and the tip locator is retained with the device.

11. A cleaning device as claimed in claim 1, wherein the tip locator has steps in its socket for centering different sizes of paint brush tip.

12. A cleaning device as claimed in claim 3, wherein the tip locator is dimensioned to extend out of the internal collar when its external collar abuts the internal collar, the portion of the tip locator extending to receive a paint brush tip that is wider than it is thick.

13. A cleaning device as claimed in claim 1, wherein the complementary formation of the jaws are wedge faces for abutting the sleeve.

14. A cleaning device as claimed in claim 1, wherein the jaws have concave gripping faces for centering a paint brush shank.

15. A cleaning device as claimed in claim 14, wherein the jaws are formed with open bottom slots set back from the gripping faces to provide the faces with resilience.

16. A cleaning device as claimed in claim 1, wherein the tubular portion of the shank holder is smaller than the internal size of the sleeve.

17. A cleaning device as claimed in claim 16, wherein the tangs extend from the tubular portion at the same external diameter as the tubular portion in their free state.

18. A cleaning device as claimed in claim 1, including a collar for centering a paint roller cover on the device at the hub end of the device.

19. A cleaning device as claimed in claim 18, wherein the hub has a groove on the drive shaft side of its sleeve abutment and the collar has a rim dimensioned to locate in the groove.

* * * * *